United States Patent [19]

Pleger et al.

[11] 4,166,420

[45] Sep. 4, 1979

[54] RAILWAY BOGIE EMERGENCY RUN GUIDE ASSEMBLY

[75] Inventors: Johannes Pleger, Pöcking über Starnberg; Manfred Preuss, Netphen, both of Fed. Rep. of Germany

[73] Assignee: Waggon Union GmbH, Fed. Rep. of Germany

[21] Appl. No.: 832,604

[22] Filed: Sep. 12, 1977

[30] Foreign Application Priority Data

Sep. 17, 1976 [DE] Fed. Rep. of Germany ..... 2641809

[51] Int. Cl.[2] ..... B61F 3/08; B61F 5/06; B61F 5/32; B61F 5/38

[52] U.S. Cl. ..... 105/224 R; 267/3; 308/3 R

[58] Field of Search ..... 105/224 R; 267/3, 4; 308/3 R

[56] References Cited

U.S. PATENT DOCUMENTS

| | | | |
|---|---|---|---|
| 1,096,367 | 5/1914 | Head | 105/224 R |
| 1,377,700 | 5/1921 | Lamont | 105/224 R |

*Primary Examiner*—Francis S. Husar
*Assistant Examiner*—Howard Beltran
*Attorney, Agent, or Firm*—McGlew and Tuttle

[57] ABSTRACT

An emergency run guide assembly for the axles of a bogie frame for rail cars which have axle boxes and wich have spring leaf guide rods for the axle guidance of bogies which are secured at their one ends on the bogie frame and at their other ends on the axle boxes, and which guide rods are subjected to breakage, comprises a secondary guide system including bushings secured vertically on the bogie frame and having a central bushing wall. An axle box housing on the axle of the bogies is provided with a bore for the vertical mounting of a bolt thereon. A cylindrical sleeve member has an open bottom end and an opposite top closed end with a bore therethrough and it is mounted on the bolt with its open end downwardly. The walls of the sleeve member are spaced radially outwardly of the bolt and radially inwardly of the cylindrical bushing wall and the sleeve member is secured to the bolt by means of a locking screw which extends through the opening of the sleeve member and is threaded into the bolt.

5 Claims, 2 Drawing Figures

RAILWAY BOGIE EMERGENCY RUN GUIDE ASSEMBLY

FIELD AND BACKGROUND OF THE INVENTION

This invention relates in general to rail cars and, in particular, to a new and useful emergency run guide for the axles of a bogie for rail cars, where the guidance of the axles is effected primarily by spring leaf guide rods which are secured at one end on the bogie frame and at the other end on the axle box, and where a secondary guide of the axle box housing is provided on the bogie frame for the emergency run of the axle in case of a rupture of the spring leaf guide rod, this secondary guide consisting of a bushing vertically secured on the bogie frame, with a bolt arranged at the top of the axle box housing, which is guided in this bushing.

DESCRIPTION OF THE PRIOR ART

An emergency run guide assembly is formally required for the axle in the axles of a railroad bogie guided by means of spring leaf guide rods, in order to prevent derailing of the wheel set and thus, the probability of accidents, in the case of a rupture of a spring leaf guide rod. This emergency run guide assembly should be so designed that the track safety of the bogie is preserved within the framework necessary for the emergency run.

Emergency run guides assembly for the axles of a bogie are already known. In one of these known embodiments, a pin with a square cross-section is forged vertically at the top on the axle box housing of the wheel set, which is guided vertically in a corresponding bushing of the bogie frame. The pin is provided with a vertical elongated slot and a bolt is passed through this slot and the bushing of the bogie frame to prevent the pin from being lifted out. A disadvantage of this embodiment is the inaccurate guidance of the pin in the bushing, the assembly costs in changing the wheel set or spring leaf guide rods and the design of the pin as a part forged on the axle box housing which requires the use of a high-grade material for the pin and also for the axle box housing.

Another emergency run guide assembly for the axles of a bogie of the type mentioned above is known, wherein a cylinder bolt is secured vertically on top of the axle box housing by means of a screw joint. A bushing is pushed over this bolt with a collar at its upper end. The bushing is secured over it collar by means of a screw joint on the bogie frame. The bolt is provided at its upper end with a centrally arranged screw which secures a disc which cooperates with the bogie frame to prevent it from being lifted out. A disadvantage of this embodiment is also the inaccurate guidance of the bolt of the axle box housing in an emergency run in the bushing, since in the automatic canting of the axle box housing in an emergency run, the bolt is also canted, and only bears punctiformly or linearly on the ends of the bushing. Another disadvantage of this embodiment is again the high assembly costs for a change of the wheel set or spring leaf guide rods, and that a plurality of screw joints are required.

SUMMARY OF THE INVENTION

In accordance with the present invention, axles of a rail bogie include an emergency run guide assembly which reduces the assembly costs of changing the wheel set or spring leaf guide rods to a minimum, permits an exact adjustment of the emergency run guide assembly with uniform play on all sides, and ensures a maximum guide surface of the corresponding part in an emergency run.

According to the invention, a sleeve is placed in a reverse position from the top over the bolt between the bolt and the bushing of the bogie frame and is rigidly connected with the bolt. Play is provided between the outer surface of the sleeve and the bolt or the bushing of the bogie. The sleeve is here secured axis-parallel or coaxially on the bolt by means of a screw guided through a center bore in its bottom, the play between the screw shaft and the sleeve corresponding at least to the play between bolt and sleeve. The bushing of the bogie frame carries, at its free bottom end, an inwardly pointing collar, the inside diameter of which is smaller than the outside diameter of the sleeve.

This embodiment according to the invention reduces the assembly work in a change of the spring leaf guide rods of axles to a minimum, that is, it is reduced to the loosening of a single screw joint. This sleeve, which is pushed over the bolt, can be adjusted centrally in the bushing of the bogie frame and may be secured on the bolt, so that the emergency run guide assembly can be exactly adjusted on all sides with the same play. In an emergency run of the axle and the resulting canting of the axle box housing, the sleeve will yield elastically when the bushing of the bogie frame bears on its outer surface and ensures a maximum bearing surface between the bushing of the bogie frame and the sleeve.

Accordingly, it is an object of the invention to provide an emergency run guide assembly for the axles of a bogie for rail cars for the axle guidance of the axles which is effected primarily by means of spring leaf guide rods which are secured at their one ends on the bogie frame and at their other ends on the axle box, and including a secondary guide for the axle box housing on the bogie frame for the emergency run of the axle in case the spring leaf guide rod breaks, the secondary guide comprising a bushing secured vertically on the bogie frame and a bolt arranged on the axle box housing and guided in the bushing and, wherein, the sleeve member turned upside down, is engaged on the top of the bolt between the bolt and a bushing of the bogie frame and is rigidly connected with the bolt, and wherein, a clearance is provided between the outer surface of the sleeve and the bolt and the bushing of the bogie frame.

A further object of the invention is to provide an emergency run guide assembly for axles of a bogie frame which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figure 1:
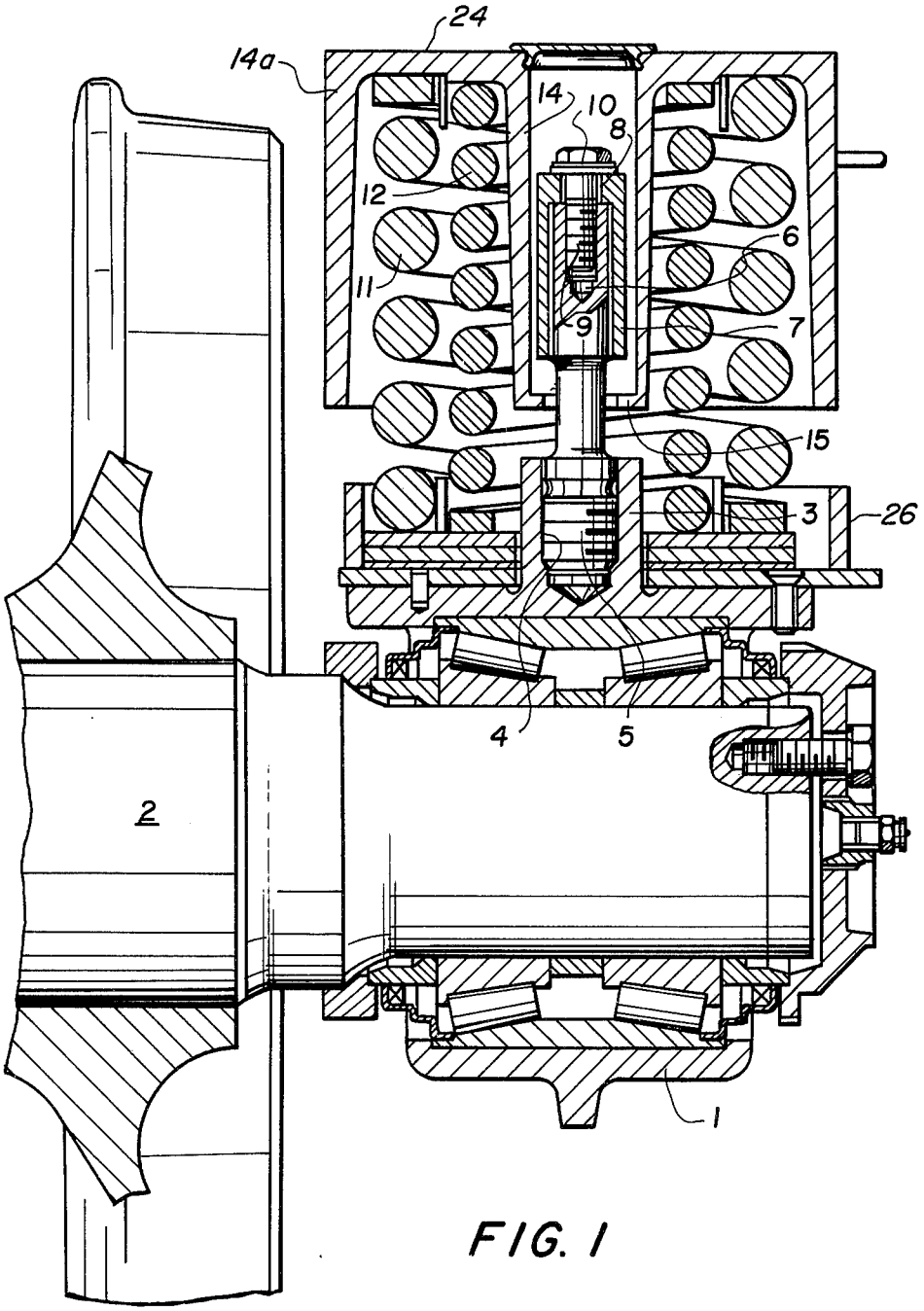
FIG. 1 is partial axial sectional view of an emergency run guide assembly for the axes of a bogie frame for rail cars constructed in accordance with the invention.
Figure 2:
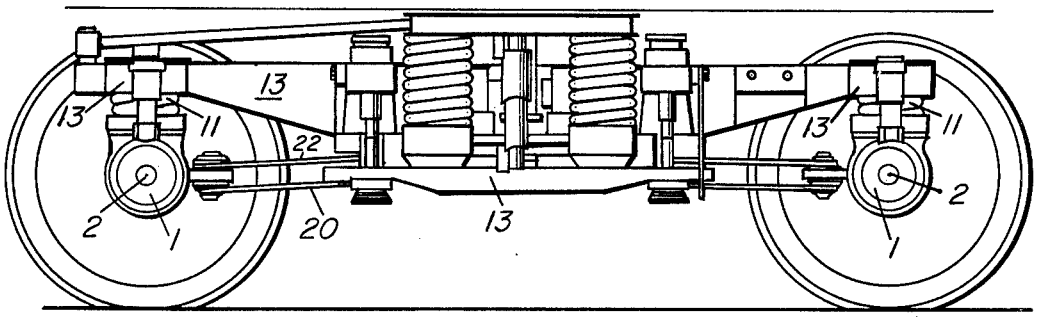
FIG. 2 is a side elevational view of a truck comprising the emergency run guide assembly in accordance with the invention.

Referring to the drawing in particular, the invention embodied therein, comprises an emergency run guide assembly for the axles, such as an axle 2, which is effected primarily by means of spring leaf guide rods 20 and 22 which are secured at one end on a bogie frame 13 and on the other end, on an axle box housing 1. The apparatus includes a secondary guide of the axle box housing provided on the bogie frame for emergency running of the axle in case a spring leaf guide rod breaks.

The axle box housing 1 of axle 2 is formed on its top side with a lug 3 which is provided with a vertically extending threaded bore 4. The bolt 5 is threaded into bore 4 and secured therein by suitable means. The bolt is provided with a top end having an outwardly extending centric bore 6. In accordance with a feature of the invention, a cylindrical sleeve member 7 has a top end with a bore 8 which is positioned over the bolt 5 with its open bottom end extending downwardly. Sleeve member 7 is secured on bolt 5 by means of a threaded screw 9 and a locking device 10. A clearance is provided between the shaft of the bolt 5 and the outer surface of sleeve 7. Bore 8 in the bottom of the sleeve member 7 also has a similar clearance with the screw 9 which has at least the same clearance as between the outer surface of sleeve 7 and bolt 5. Frame 13 of the bogie has a fixed bushing 14 in its center, in which bolt 5 with sleeve 7 is guided with clearance. Bushing 14 has a bottom end with an inwardly protruding collar 15 with an inside diameter which is smaller than the outside diameter of bushing sleeve 7. Bushing 14 also includes an outer cylindrical spring housing part 14*a* which has a closed top 24 which bears against the frame 13. Coil springs 11 and 12 are supported on a receiving cup 26 formed around the lug 3 on the axle box housing 1.

Bogie frame 13 is guided, with bushing 14, over bolt 5 in the assembly of the bogie frame 13 on the axle box housing 1 and it is braced on axle box housing 1 on coil springs 11 and 12 which are held between cup 26 and the frame 13 and are disposed around the collar 15 within spring housing part 14*a*. Then, the sleeve 7 is turned upside down on bolt 5 and is adjusted centrally by means of a suitable measuring instrument in bushing 14 and is secured by means of screw 9. Sleeve 7, with bushing 14, forms an emergency run guide for axle 2, and with collar 15 of bushing 14, forms the lift-out safety device for the axle. The springs 11 and 12 are supported on the axle box 1 of the axle 2 and bear from below against the frame 13 of the truck. Thus the helical springs 11 and 12 function as the primary springs between the frame 13 of the truck and the axle.

While a specific embodiment of the invention has been shown and described in detail to illustrate the application of the principles of the invention, it will be understood that the invention may be embodied otherwise without departing from such principles.

What is claimed is:

1. An emergency run guide assembly for the axles of a bogie frame for rail cars which have axle boxes and which also have spring leaf guide rods for the axle guidance which are secured at their one ends on the bogie frame and at their opposite ends to the axle boxes, and which spring leaf guide rods are subject to breakage, comprising, a secondary guide including a bushing secured vertically on the bogie frame and having a cylindrical bushing wall, an axle box housing on the axle of the bogies, a bolt mounted on the axle box housing and secured in a substantially vertical position, a cylindrical sleeve member having an open bottom end and an opposite top closed end with a bore through the top closed end and being mounted on said bolt with its open bottom end extending downwardly and having walls spaced radially outwardly of said bolt and spaced inwardly of said cylindrical bushing wall, and a screw engaged into the bore of the sleeve member and threaded into said bolt.

2. An emergency run guide assembly for the axles of a bogie frame for rail cars, as claimed in claiam 1, wherein said sleeve member is secured coaxially of said bolt by means of a screw passing through the central bore of said bolt, the clearance between said screw and said sleeve member at least corresponding to the clearance between said bolt and said sleeve member.

3. An emergency run guide assembly for the axles of a bogie frame for rail cars, as claimed in claim 1, wherein said bushing of the bogie frame has a bottom end with a radially inwardly extending collar, the inside diameter of said collar being smaller than the outside diameter of said sleeve.

4. An emergency run guide assembly according to claim 1, including coil spring means disposed around said bushing and bearing between the bogie frame and said axle box.

5. An emergency run guide assembly according to claim 1, wherein said cylindrical bushing wall comprises an inner bushing wall, and including an outer cylindrical bushing wall disposed concentrically around said inner bushing wall and a closed bushing and wall closing the space between said outer and inner bushing walls at the top thereof and adapted to abut against the bogie frame and coil spring means in the space between said inner and outer cylindrical bushing walls bearing between the bogie frame and said axle box housing.

* * * * *